US005086523A

United States Patent [19]

De Mott et al.

[11] Patent Number: 5,086,523

[45] Date of Patent: Feb. 11, 1992

[54] SANITARY ATTACHMENT MEANS FOR A TOILET SEAT WHICH FEATURES A REPLACEABLE DEODORIZER AND SERVES AS A HANDLE TO LIFT AND LOWER SEAT

[76] Inventors: Corinne De Mott, 1937 Wilhelmina Rise, Honolulu, Hi. 96816; Ghary D. Won, 1717 Ala Wai Blvd., #1406, Honolulu, Hi. 96815

[21] Appl. No.: 564,355

[22] Filed: Aug. 8, 1990

[51] Int. Cl.[5] ..... A47K 13/10

[52] U.S. Cl. ..... 4/251; 16/114 R

[58] Field of Search ..... 4/251, 661, 237, 239, 4/234, 235; 16/114 R

[56] References Cited

U.S. PATENT DOCUMENTS

| | | | |
|---|---|---|---|
| 1,052,077 | 2/1913 | McMillan | 16/114 R |
| 1,131,863 | 3/1915 | Phillips | 16/114 R |
| 2,236,576 | 4/1941 | Loebner | 4/251 |
| 3,191,193 | 6/1965 | Bogenberger | 4/251 |
| 3,621,510 | 11/1971 | Rollins, Jr. | 16/114 R |
| 3,783,455 | 1/1974 | Vanderbrook | 4/251 X |
| 3,935,601 | 2/1976 | Hermann | 4/251 |
| 4,129,907 | 12/1978 | Vaughan et al. | 4/251 |
| 4,574,401 | 3/1986 | Nakajima | 4/251 |
| 4,805,246 | 2/1989 | De Vargas et al. | 4/251 |
| 4,850,062 | 7/1989 | Gibson et al. | 4/251 |
| 4,875,251 | 10/1989 | Hazard | 4/251 X |

*Primary Examiner*—Henry J. Recla
*Assistant Examiner*—Robert M. Fetsuga
*Attorney, Agent, or Firm*—Michael I. Kroll

[57] ABSTRACT

A sanitary attachment mounted to a toilet seat of a toilet is disclosed. The attachment includes a removable handle portion, and a deodorizer portion, both portions being integral with each other and being received in a bracket mounted to the underside of the toilet seat so that a user can lift and lower the toilet seat without becoming contaminated.

13 Claims, 2 Drawing Sheets

SANITARY ATTACHMENT MEANS FOR A TOILET SEAT WHICH FEATURES A REPLACEABLE DEODORIZER AND SERVES AS A HANDLE TO LIFT AND LOWER SEAT

BACKGROUND OF THE INVENTION

1. Field of the Invention

The present invention relates to a toilet seat.

More particularly, the present invention relates to a sanitary attachment which includes an integral replaceable deodorizer portion and which prevents direct contact between the user's hands, the toilet seat, and the deodorizing portions.

2. Description of the Prior Art

During the course of a preliminary patentability search of the present invention, three U.S. patents with possible relevance to the present invention were uncovered. They are:

U.S. Pat. No. 1,999,555 to Adams;

U.S. Pat. No. 2,081,249 to Pryba; and

U.S. Pat. No. 3,783,455 to Vanderbrook.

The U.S. Pat. No. 1,999,555 to Adams teaches a handle fixedly attached to a toilet seat for raising and lowering the toilet seat without the danger of contaminating the user's hand. However, no provision is provided on the handle for holding a deodorant.

The U.S. Pat. No. 2,081,249 to Pryba teaches a counterbalance weight containing a porous deodorizer which is located on a bar which is displaced a distance from the toilet seat. However, the deodorant is discharged only when the toilet seat is raised or lowered.

The U.S. Pat. No. 3,783,455 to Vanderbrook teaches a rod fixedly attached to a toilet seat for raising and lowering the toilet seat without the danger of contaminating the user's hand. However, located around the bar is a porous body which soaks up a vaporizing germicide liquid.

Numerous innovations for toilet bowl deodorizers have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide an integral, replaceable deodorizer which includes a sanitary attachment that avoids the disadvantages of the prior art.

When a home or public toilet is used, direct contact with the toilet seat is inevitable. This usually involves the user having to touch the toilet seat with his hands. However, the present invention eliminates direct contact between the user's hands, the toilet seat, and the deodorizing unit.

Most toilet deodorizers are in spray form or mount by hanging on the inside rim of the toilet bowl and making it easily visible to the users, with regards to an eyesore.

The present invention teaches a replaceable deodorizer which is not easily visible to the users when the toilet seat is in the lowered position, and which further prevents direct contact between the user's hands, the toilet seat, and the deodorizing unit, and can be lowered without contacting the toilet bowl rim.

A medium for preventing direct contact between the user's hands, the toilet seat, and the deodorizing unit, includes a replaceable packet of solid deodorizer which is not easily visible to the users when the toilet seat is in the lowered position.

The present invention provides an alternative to toilet deodorizers which hang in the toilet bowl or otherwise attach in the bathroom area in a visible location.

In keeping with these objects, and with others which will become apparent hereinafter, one feature of the present invention resides, briefly stated, in a sanitary attachment mounted to a toilet seat of a toilet, comprising, a handle portion having sides, and a bracket portion slidably receiving the handle portion.

Still yet another feature of the present invention is that the bracket is mounted to the underside of the toilet seat so that a user can lift and lower the toilet seat and change the replaceable solid deodorant without becoming contaminated.

Another feature of the present invention is that the bracket portion contains opposing "U"-channels.

Yet another feature of the present invention is that the opposing "U"-channels are a pair.

Still another feature of the present invention is that the pair of opposing "U"-channels are connected to each other by a frame member 17. An attachment as defined in claim 16, wherein the pair of "U"-channels and the frame member together form a substantially square unit.

Yet still another feature of the present invention is that the pair of opposing "U"-channels form tracks.

Still yet another feature of the present invention is that the handle portion slides in and out on the tracks of the pair of opposing "U"-channels so that the deodorizer portion can be easily removed from the underside of the toilet when the deodorizer portion requires service.

Another feature of the present invention is that the tracks of the bracket portion each contain a recess.

Yet another feature of the present invention is that the sides of the handle portion each contain a locking mechanism so that the handle portion can be secured to the bracket portion.

Still another feature of the present invention is that the locking mechanism includes a protrusion disposed on the each of the sides of the handle portion.

Yet still another feature of the present invention is that the protrusions are made from a springy material.

Still yet another feature of the present invention is that the bracket portion has an upper face.

Another feature of the present invention is that the upper face of the bracket portion contains an adhesive layer so that the bracket portion can be easily mounted to the underside of the toilet.

Yet another feature of the present invention is that it further comprises a peel off sheet for protecting the adhesive layer.

Still another feature of the present invention is that the deodorant portion has a front face and a partition.

Yet still another feature of the present invention is that the front face and the partition are substantially parallel.

Still yet another feature of the present invention is that the front face and the partition define the longitudinal boundaries of the deodorant portion.

Another feature of the present invention is that the front face is relatively flush with the inner boundary of the toilet seat so that obstruction during defecation and voiding is eliminated.

Yet another feature of the present invention is that the partition is relatively flush with the outer boundary of the toilet seat.

Still another feature of the present invention is that the pair of "U"-channels include sides that the pair of "U"-channels lie on in order to form a pair of tracks.

Yet still another feature of the present invention is that the handle portion slides in an out of the pair of tracks so that when it becomes necessary to change the deodorant the handle portion is simply slid out of the bracket portion.

Still yet another feature of the present invention is that the each of the pair of tracks of the bracket portion contain a recess so that when the handle portion is secured in the bracket portion each of the recesses receive each of the protrusions that are provided on each side of the handle portion..

Another feature of the present invention is that the deodorizer portion is substantially cage-like so that air is allowed to circulate from the area under the toilet seat to the area around the deodorizer portion.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS UTILIZED IN THE DRAWING

Figure 1:
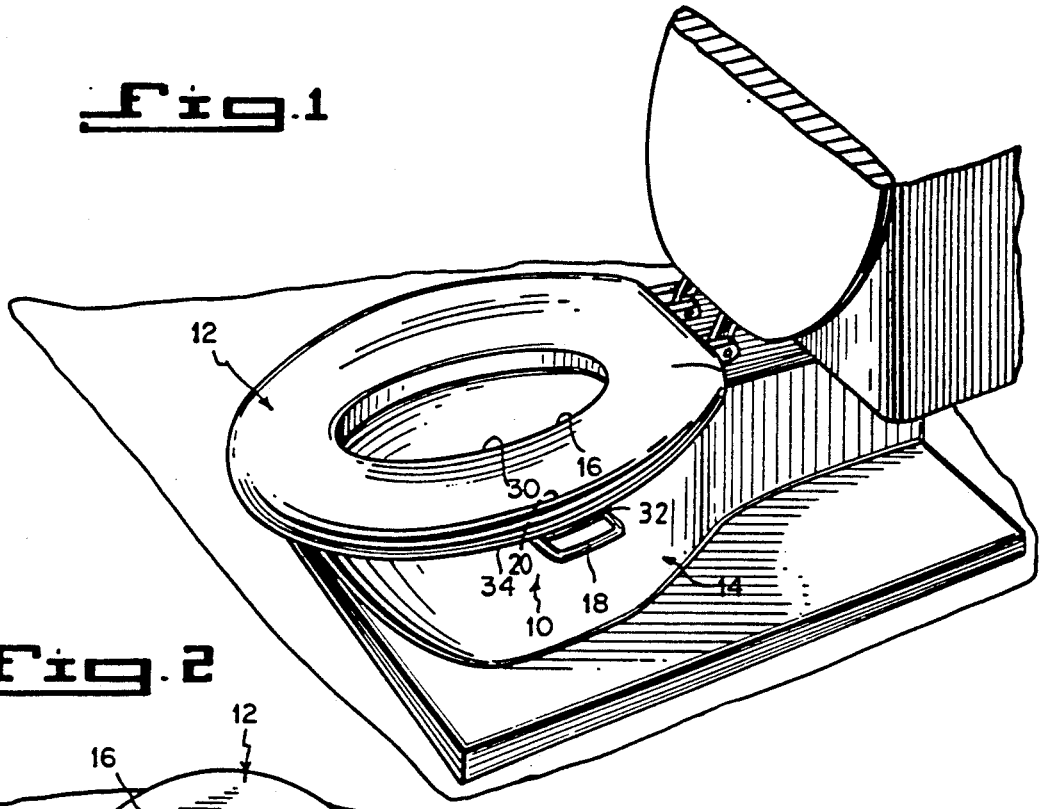
FIG. 1 is a three-quarter perspective view of the toilet, with the present invention attached, and with only the handle exposed.

10—sanitary attachment for lifting and lowering a toilet seat and which includes an integral replaceable deodorizer

12—toilet seat of the sanitary attachment for lifting and lowering a toilet seat and which includes an integral replaceable deodorizer of the present invention 10

14—toilet for receiving the toilet seat 12

16—under side of the toilet seat 12 for receiving the sanitary attachment for lifting and lowering a toilet seat and which includes an integral replaceable deodorizer 10

18—handle portion of the sanitary attachment for lifting and lowering a toilet seat and which includes an integral replaceable deodorizer of the present invention 10

20—deodorizing portion of the sanitary attachment for lifting and lowering a toilet seat and which includes an integral replaceable deodorizer of the present invention 10

21—bracket portion of the sanitary attachment for lifting and lowering a toilet seat and which includes an integral replaceable deodorizer of the present invention 10

22—first "U"-channel of the bracket portion 21

23—upper face of the handle portion 18

24—second "U"-channel of the bracket 21

26—frame member of the bracket portion 21

28—front face of the sanitary attachment for lifting and lowering a toilet seat and which includes an integral replaceable deodorizer 10

29—substantially square unit of the sanitary attachment for lifting and lowering a toilet seat and which includes an integral replaceable deodorizer 10

30—inner boundary of the toilet seat 12

31—side of the "U"-channel 22

32—partition relatively flush with the outer boundary 34

33—side of the "U"-channel 24

34—outer boundary of the toilet seat 12

35—first track of the bracket 21

36—solid deodorant of the sanitary attachment for lifting and lowering a toilet seat and which includes an integral replaceable deodorizer 10

37—second track of the bracket 21

39—second recess in the second track 37

40—first recess in the first track 35

42—first protrusion of the handle portion 18

44—second protrusion of the handle portion 18

46—first side of the handle portion 18

48—second side of the handle portion 18

50—compartment of the handle portion 18

54—upper face of the bracket portion 21

55—screen of the handle portion 18

56—adhesive layer

57—vented area of the handle portion 18

58—peel off sheet to protect the adhesive layer 56

60—front face of the handle portion 18

62—inner boundary of the toilet seat 12

64—partition of the handle portion 18

66—outer boundary of the toilet seat 12

DETAILED DESCRIPTION OF THE PREFERRED EMBODIMENT

Figure 2:
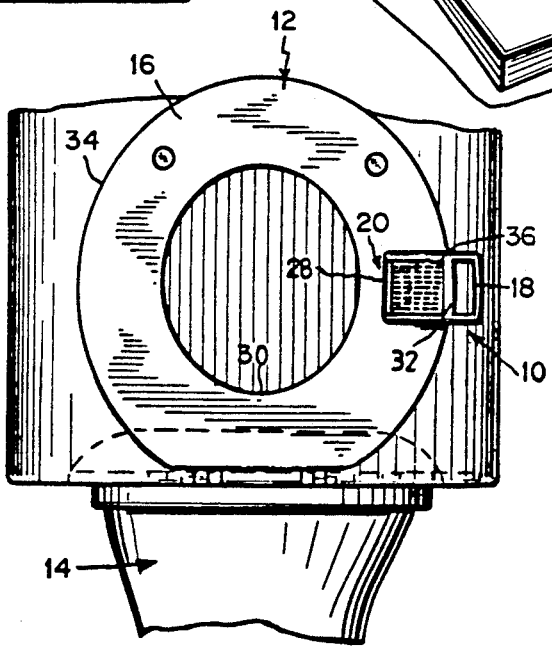
FIG. 2 is a front view of the toilet, whose seat is raised and shows the present invention attached to the underside of the toilet seat.

Referring now to FIGS. 1 and 2, the sanitary attachment for lifting and lowering a toilet seat and which includes a integral replaceable deodorizer is shown generally at 10, mounted to a toilet seat 12 of a toilet 14.

As shown in FIG. 2, the sanitary attachment for lifting and lowering a toilet seat and which includes an integral replaceable deodorizer of the present invention 10 mounts on the underside 16 of the toilet seat 12.

The sanitary attachment for lifting and lowering a toilet seat and which includes an integral replaceable deodorizer of the present invention 10, includes a handle portion 18 and a deodorizer portion 20. The handle portion 18 of the sanitary attachment for lifting and lowering a toilet seat and which includes an integral replaceable deodorizer of the present invention 10, is exposed. However, the deodorizer portion 20 is concealed on the underside 16 of the toilet seat 12.

The sanitary attachment for lifting and lowering a toilet seat and which includes an integral replaceable deodorizer of the present invention 10, is positioned, as shown in FIG. 2, with the front face 28, relatively flush with the inner boundary 30 of the toilet seat 12 and with the partition 32 relatively flush with the outer boundary 34 of the toilet seat 12.

Attaching the sanitary attachment for preventing direct contact between the user's hands, the toilet seat, and the deodorizinq unit, and which includes an integral replaceable deodorizer of the present invention 10 is to the underside 16 of the toilet seat 12, as shown in FIG.

3. The sanitary attachment for lifting and lowering a toilet seat and which includes an integral replaceable deodorizer of the present invention 10 includes two portions: A bracket portion 21, and a handle 18.

The bracket portion 21 contains a pair of opposing "U"-channels 22 and 24 connected to each other by a frame member 26 and forming a substantially square unit 29.

The "U"-channels 22 and 24 lie on their sides 31 and 33, respectively, and form tracks 35 and 37 on which the handle portion 18 slides in and out on when it becomes necessary to change the deodorant.

In order to secure the handle portion 18 into the bracket portion 21, recesses 39 and 40 are provided on each of the tracks 35 and 37. These recesses 39 and 40 receive springy protrusions 42 and 44 that are provided on each side 46 and 48 of the handle portion 18.

The upper face 54 of the bracket portion 21 contains an adhesive layer 56 protected by a peel off sheet 58.

Figure 3:
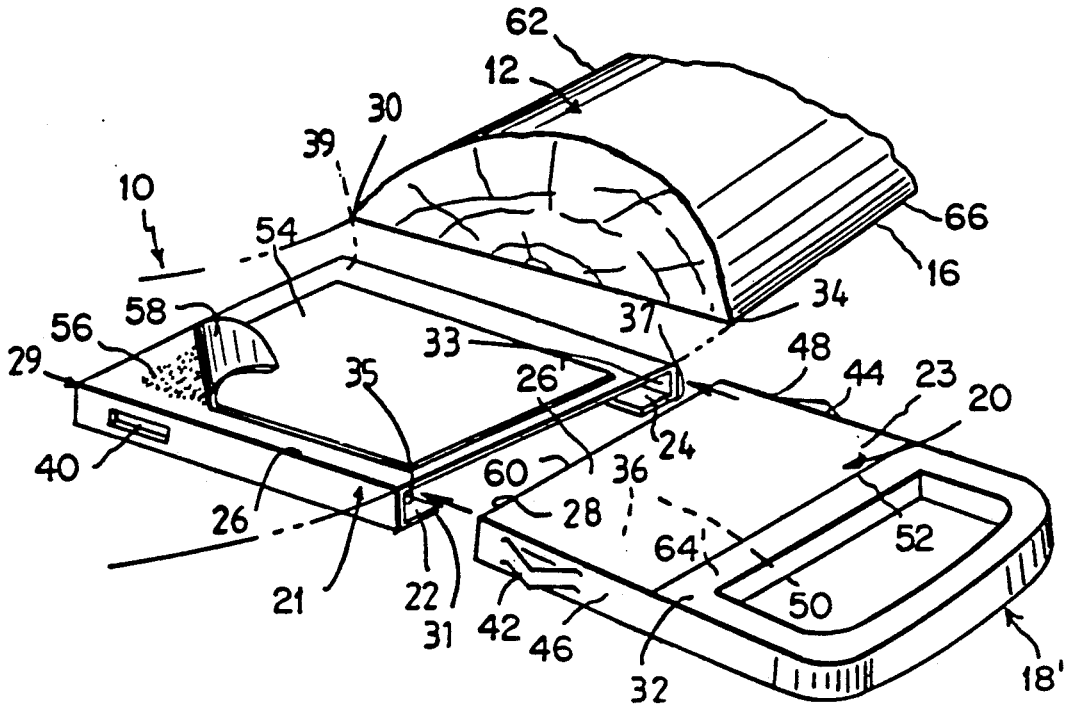
FIG. 3 is a three-quarter perspective view of the bracket portion of the present invention.
Figure 4:
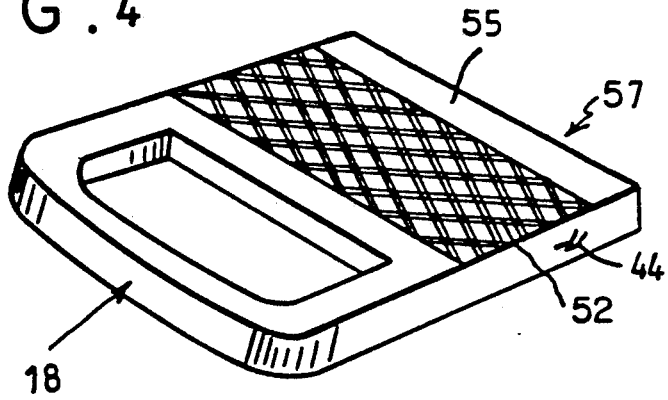
FIG. 4 is a three-quarter perspective view of the handle portion of the present invention.

The peel off sheet 58 is removed revealing the adhesive layer 56. As shown in FIG. 3, the sanitary attachment for lifting and lowering a toilet seat and which includes an integral replaceable deodorizer of the present invention 10 is so positioned that the front face 60 is relatively flush with the inner boundary 62 of the toilet seat 12, and the partition 64 is relatively flush with the outer boundary 66 of the toilet seat 12.

The handle portion 18 extends outwardly from underneath the toilet seat 12 and is visible to only the users when the toilet seat 12 is in the lowered position. The bracket portion 21 attaches under the toilet seat 12 by use of the adhesive layer 56 which is easy to use and does not require any tools.

The deodorizer portion 20, a cage-like device, which allows air to circulate from the area under the toilet seat 12 to the area around the deodorizer. The cage can be snapped open to replace the solid deodorant 36 when needed and then shut.

It will be understood that each of the elements described above, or two or more together, may also find a useful application in other types of constructions differing from the type described above.

While the invention has been illustrated and described as embodied in a sanitary attachment for lifting and lowering a toilet seat and which includes an integral replaceable deodorizer, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed and desired to be protected by Letters Patent is set forth in the appended claims:

1. A sanitary attachment adapted to be mounted to an undersurface of a toilet seat of a toilet, comprising:

a) a substantially rectangular, planar handle portion having a through opening in a first end portion thereof and a cavity in a second end portion thereof, said cavity having a replaceable solid deodorant therein; and b) a bracket portion slidably receiving said handle portion, said bracket portion having a substantially rectangular, planar top member including means for attachment to the undersurface of the toilet seat, said top member having a pair of depending "L"-shaped flanges on opposing edges thereof defining therewith "U"-shaped channels being sized to slidably receive opposing sides of said second end portion therewithin, said bracket portion being oriented such that said first end portion extends laterally of the toilet seat to be grasped by a user when said second end portion is received in said channels.

2. An attachment as defined n claim 1, wherein the vertical legs of said channels each contain a recess and said sides of said second end portion each contain a locking mechanism engaging said recesses so that said handle portion can be secured to said bracket portion.

3. An attachment as defined in claim 2, wherein said locking mechanism includes a protrusion disposed on said each of said sides of said second end portion.

4. An attachment as defined in claim 3, wherein said protrusions are made from a springy material.

5. An attachment as defined in claim 4, wherein said attachment means comprises an adhesive layer so that said bracket portion can be easily mounted to the undersurface of the toilet sea.

6. An attachment as defined in claim 5; wherein said attachment means further comprises a peel off sheet for protecting said adhesive layer.

7. An attachment as defined in claim 5, wherein said cavity is defined by a bottom wall, said sides of said second end portion, an end wall of said second end portion and a partition wall between said cavity and said opening of said first end portion.

8. An attachment as defined in claim 7, wherein said end wall and said partition are substantially parallel.

9. An attachment as defined in claim 8, wherein said end wall is spaced laterally outwardly of an inner boundary of the toilet seat so as not to be visible when the seat is down.

10. An attachment as defined in claim 9, wherein said partition is relatively flush with an outer boundary of the toilet seat.

11. An attachment as defined in claim 10, wherein said pair of "U"-channels form a pair of tracks.

12. An attachment as defined in claim 11, wherein said handle portion is slid out of said pair of tracks when it becomes necessary to change the deodorant.

13. An attachment as defined in claim 12, wherein said bottom wall of said cavity is substantially cage-like so that air is allowed to circulate from the area under the toilet seat to the area around said deodorizer portion.

* * * * *